US005239704A

United States Patent [19]

Cornelio et al.

[11] Patent Number: 5,239,704

[45] Date of Patent: Aug. 31, 1993

[54] VISORED CAP WITH VISOR IN DISPLACED POSITION

[76] Inventors: David A. Cornelio, 21 Chapel St., Milford, Conn. 06460; Robert J. Fortune, 48 Short Beach Rd., East Haven, Conn. 06512

[21] Appl. No.: 981,917

[22] Filed: Nov. 23, 1992

Related U.S. Application Data

[63] Continuation of Ser. No. 877,087, May 1, 1992, abandoned.

[51] Int. Cl.[5] ..... A42B 1/04

[52] U.S. Cl. ..... 2/195.2; 2/12

[58] Field of Search ..... 2/12, 171, 175, 195, 2/196, 197, 199, 418

[56] References Cited

U.S. PATENT DOCUMENTS

| | | | |
|---|---|---|---|
| 5,091,994 | 3/1992 | Delane | 2/195 |
| 5,099,524 | 3/1992 | Linday | 2/195 |
| 5,105,476 | 4/1992 | Cox | 2/12 |
| 5,119,514 | 6/1992 | Woehl | 2/195 |
| 5,136,726 | 8/1992 | Kellin | 2/171 |
| 5,142,705 | 9/1992 | Edwards | 2/418 |

FOREIGN PATENT DOCUMENTS

| | | | |
|---|---|---|---|
| 8117 | of 1884 | United Kingdom | 2/195 |
| 17570 | of 1892 | United Kingdom | 2/195 |

*Primary Examiner*—Clifford D. Crowder
*Assistant Examiner*—Diana Biefeld
*Attorney, Agent, or Firm*—John H. Crozier

[57] ABSTRACT

In a preferred embodiment, a visored cap having a crown portion with opposing front and rear portions and with two opposing side portions, the visored cap including: providing the visor displaced from its normal position of being attached to and extending forwardly from the perimeter of the front portion, such that the visor is attached to and extends outwardly from the perimeter of one of the side portions.

4 Claims, 1 Drawing Sheet

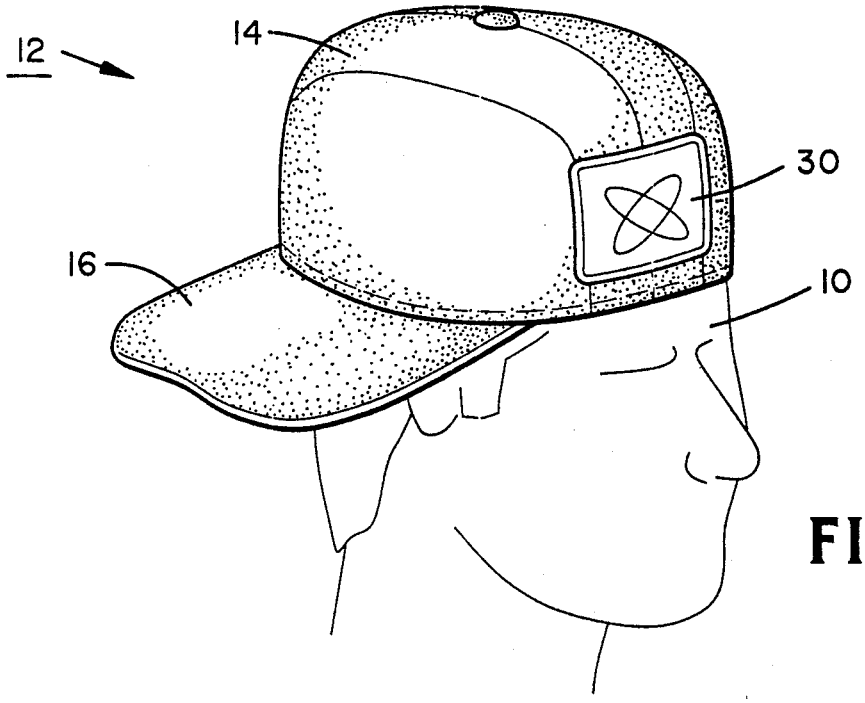
FIG. 1
FIG. 2
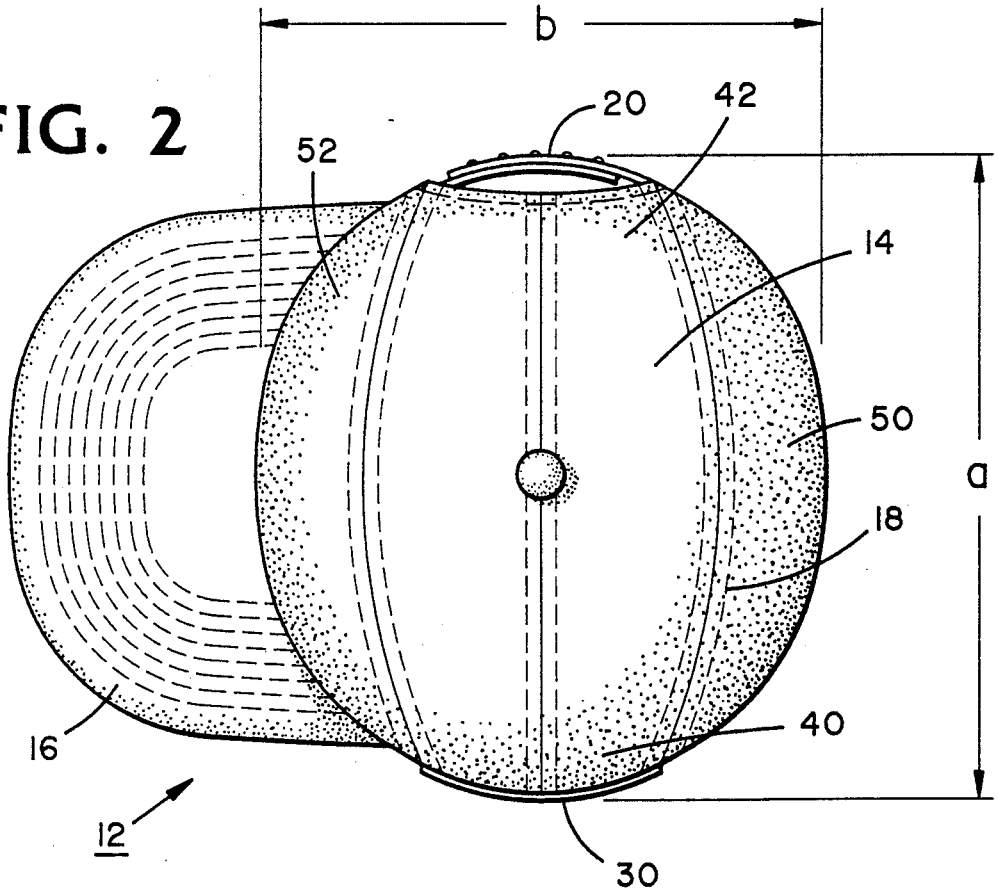

VISORED CAP WITH VISOR IN DISPLACED POSITION

This is a continuation of co-pending application Ser. No. 07/877,087 filed on May 1, 1992, now abandoned.

BACKGROUND OF THE INVENTION

1. Field of the Invention

The present invention relates to headgear generally and, more particularly, but not by way of limitation, to a novel visored cap having the visor thereof arranged so that the cap may be worn comfortably with the visor extending over one ear.

2. Background Art

It has become fashionable, particularly among younger teenagers, to wear visored caps rotated 90 degrees from the normal wearing position so that the visor extends over one ear.

A disadvantage with wearing such caps in such a position is that the adjusting band normally provided at the rear of the caps is then disposed over the other ear. That and the fact that the cap is not shaped to fit the head of a user when so worn, make such wearing somewhat uncomfortable.

Another disadvantage of conventional caps so worn is that the indicia frequently disposed on caps, such as baseball team insignia, are no longer visible by someone facing the front of the wearer.

Accordingly, it is a principal object of the present invention to provide a visored cap which can be worn comfortably with the visor extending over one ear.

It is a further object of the invention to provide such a visored cap that provides for indicia to be seen from the front of the wearer of the cap.

It is an additional object of the invention to provide such a cap which is as economically constructed as are conventional caps.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a visored cap having a crown portion with opposing front and rear portions and with two opposing side portions, comprising: providing said visor displaced from its normal position of being attached to and extending forwardly from the perimeter of said front portion, such that said visor is attached to and extends outwardly from the perimeter of one of said side portions.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which:

FIG. 1 is a top/front/right side perspective view of a person wearing a visored cap constructed according to the present invention.

FIG. 2 is a top plan view of the visored cap of FIG. 1.

DETAILED DESCRIPTION OF THE PREFERRED EMBODIMENTS

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a person 10 wearing a visored cap, generally indicated by the reference numeral 12, constructed according to the present invention. With reference also to FIG. 2, cap 12 includes a crown portion 14 and a visor 16 extending outwardly from the perimeter of the crown portion. Cap 12 further includes a conventional adjusting strap 20 (FIG. 2), or other conventional means, for adjusting the size of the cap to comfortably fit the head of person 10. Cap 12 also includes disposed on the front portion 40 of crown portion 14 indicia 30 which may include, for example, a team insignia and/or a slogan. Crown portion 14 may also have one or more lines of decorative and/or functional stitching, such as stitching 18, running from the front perimeter to the rear perimeter of the crown portion.

The elements of cap 12 described so far are conventional; however, according to the present invention, those elements are unconventionally arranged. As seen on FIG. 2, adjusting strap 20 is located at the rear portion 42 of the perimeter of crown 14, as is the conventional such position for adjustment means. With the present invention, visor 16 has been located in a position displaced 90 degrees from its normal position, such that the visor can be worn over the right ear of person 10 (FIG. 1), while adjusting strap 20 is in its conventional position in rear portion 42. Indicia 30 are disposed at the front of cap 12, so that they can be viewed from the front of person 10.

Referring to FIG. 2, it can be seen that crown portion 14 may be somewhat oval, with a dimension "a" between the perimeters of front and rear portions 40 and 42, respectively, of the crown being somewhat greater than a dimension "b" between perimeters of two opposing side portions 50 and 52. This is the conventional arrangement for caps; however, in cap 10, visor 16 is attached at the perimeter of side portion 52, rather than at perimeter of front portion 40.

If desired, cap 12 may be provided with visor 16 extending from the perimeter of side portion 50 so that the cap would be worn over the left ear of person 10.

Cap 12 may be economically constructed of any conventional materials by conventional means.

Accordingly, what has been provided is a visored cap which can be comfortably worn with the visor thereof extending over one ear of the wearer.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A cap, comprising:

(a) a crown portion with opposing front and rear portions and with two opposing side portions, said front portion to fit the forehead of a wearer, said rear portion to fit the rear of the head of said wearer, and side portions to fit the sides of the head of said wearer, with lower edges of said front, rear, and side portions defining an integral perimeter around the base of said crown portion;

(b) one and only one visor structure being attached to and extending generally horizontally outwardly from said perimeter of said crown portion, with no other structure extending or depending from said perimeter;

(c) said one and only one visor structure extending outwardly exclusively from the perimeter of only one of said side portions, said one and only one visor structure being horizontally rotationally displaced 90 degrees from said rear portion so as to extend over an ear of said wearer; and (d) size adjusting means disposed in said rear portion to shorten or lengthen said perimeter so as to fit the head of a wearer.

2. A visored cap, as defined in claim 1, further comprising indicia disposed on the exterior surface of said front portion.

3. A visored cap, as defined in claim 1, wherein said crown portion is somewhat oval, with the linear dimension between the perimeters of said front and rear portions being greater than the linear dimension between the perimeters of said side portions.

4. A visored cap, as defined in claim 1, further comprising decorative and/or functional stitching running along the exterior of said crown portion from said front portion to said rear portion.

* * * * *